US009847195B2

(12) United States Patent
Neubauer

(10) Patent No.: US 9,847,195 B2
(45) Date of Patent: Dec. 19, 2017

(54) ROCKER SWITCH WITH MOVABLE LIGHT DUCTS

(71) Applicant: PREH GMBH, Neustadt A. D. Saale (DE)

(72) Inventor: Steffen Neubauer, Hohenroth (DE)

(73) Assignee: PREH GMBH, Neustadt A.D. Saale (DE)

( * ) Notice: Subject to any disclaimer, the term of this patent is extended or adjusted under 35 U.S.C. 154(b) by 0 days.

(21) Appl. No.: 15/196,047

(22) Filed: Jun. 29, 2016

(65) Prior Publication Data

US 2017/0004941 A1 Jan. 5, 2017

(30) Foreign Application Priority Data

Jun. 30, 2015 (DE) ..... 10 2015 110 472
Jan. 19, 2016 (DE) ..... 10 2016 100 795

(51) Int. Cl.
*H01H 23/02* (2006.01)

(52) U.S. Cl.
CPC ..... *H01H 23/025* (2013.01); *H01H 2219/054* (2013.01); *H01H 2219/062* (2013.01); *H01H 2221/07* (2013.01)

(58) Field of Classification Search
CPC ..... H01H 23/025; H01H 23/04; H01H 2219/054; H01H 23/24; H01H 23/12; H01H 2219/062; H01H 2221/07
USPC ..... 200/315, 308, 310, 313, 553, 277.2, 339
See application file for complete search history.

(56) References Cited

U.S. PATENT DOCUMENTS 5,053,591 A * 10/1991 Theurer ..... H01H 23/065 200/302.3
7,952,044 B2 * 5/2011 Lee ..... H01H 23/143 200/315
8,570,126 B1 * 10/2013 Lee ..... H01H 23/025 335/205
2003/0155225 A1 8/2003 Kondo et al.
2015/0179369 A1 6/2015 Choi et al.

FOREIGN PATENT DOCUMENTS

DE 42 42 100 A1 6/1994
DE 195 38 618 C2 4/1997
EP 1 988 441 A1 11/2008

* cited by examiner

*Primary Examiner* — Edwin A. Leon
(74) *Attorney, Agent, or Firm* — Norman B. Thot

(57) ABSTRACT

A rocker switch includes a housing. An actuating part is pivotably mounted at the housing and includes at least two opposing actuating surfaces with two opposing actuating directions associated thereto. At least one actuating surface includes a backlit lighting surface. At least one lighting device is attached to the housing for backlighting the lighting surface. The rocker switch includes least one electromechanical pushbutton and at least one multiple-part telescoping light duct. At least one plunger is displaceably supported at the housing. The at least one plunger acts through the actuator part on the electromechanical pushbutton and the at least one light duct so as to define a light channel between the at least one lighting device and the lighting surface. The at least one light duct having a tubular lower light duct section corresponding to the electromechanical pushbutton and a tubular upper light duct section corresponding to the lighting surface.

11 Claims, 8 Drawing Sheets

ROCKER SWITCH WITH MOVABLE LIGHT DUCTS

CROSS REFERENCE TO PRIOR APPLICATIONS

Priority is claimed to German Patent Application Nos. DE 10 2015 110 472.5, filed Jun. 30, 2015, and DE 10 2016 100 795.1, filed Jan. 19, 2016. The entire disclosure of said applications is incorporated by reference herein.

FIELD

The present invention relates to a rocker switch, for example, a two-way rocker switch. The rocker switch according to the present invention comprises a housing as well as an actuating part being pivotably supported at the housing. The actuating part comprises at least two opposing actuating surfaces and defines opposing actuating directions associated thereto. There is provided at least one lighting surface that is to be backlit. For backlighting thereof at least one lighting device that is mounted on the housing is provided. In this situation, the problem of loss-free light guidance from the lighting device to the lighting surfaces arises. At the same time, unwanted leakage of light at sites other than the lighting surfaces is to be avoided.

BACKGROUND

A rocker switch with a two-piece light duct comprising an upper light duct section rigidly coupled with the actuating part and a lower light duct section formed by the housing is described in EP 1 988 441 A1. Since this duct is arranged on the pivot axis of the rocker switch, the bipartite design, shown therein, of the light duct is for enabling an angular bending of the upper light duct section from the lower light section during a pivoting operation of the actuating part. This approach becomes more critical with a greater lighting surface, and hence the light duct is spaced apart from the pivot axis. Compensating the changing distance depending on the pivoting movement between the lighting device and the lighting surface and the changing angular bend of the actuating part in relation to the housing via the light duct is also required in order to avoid unwanted leakage of light.

SUMMARY

An aspect of the present invention is to provide a rocker switch. The rocker switch according to the present invention comprises a housing. The term housing may be broadly interpreted, thus, an embodiment of the housing that partially encapsulates the operation element is not necessarily provided. In an embodiment of the present invention, the housing can, for example, be for supporting parts of the operation element as well as mounting the operation element, for example, at an operation panel or a dashboard. In an embodiment of the present invention, the housing can, for example, be wholly or partially made of a plastic material, such as a thermoplastic material, and/or a metal or a metal alloy, especially an alloy comprising zinc, aluminum, magnesium, copper.

In an embodiment, the present invention provides a rocker switch which comprises a housing. An actuating part is pivotably mounted at the housing and includes at least two opposing actuating surfaces with two opposing actuating directions associated thereto. At least one actuating surface comprises a backlit lighting surface. At least one lighting device is attached to the housing for backlighting the lighting surface. The rocker switch includes at least one electromechanical pushbutton and at least one multiple-part telescoping light duct. At least one plunger is displaceably supported at the housing. The at least one plunger acts through the actuator part on the electromechanical pushbutton and the at least one light duct so as to define a light channel between the at least one lighting device and the lighting surface. The at least one light duct comprises a tubular lower light duct section corresponding to the electromechanical pushbutton and a tubular upper light duct section corresponding to the lighting surface of the actuating part. The upper light duct section is rigidly coupled with the plunger and is elastically biased by the electromechanical pushbutton in a direction of the actuating part.

BRIEF DESCRIPTION OF THE DRAWINGS

The present invention is described in greater detail below on the basis of embodiments and of the drawings in which.

DETAILED DESCRIPTION

Figure 1:
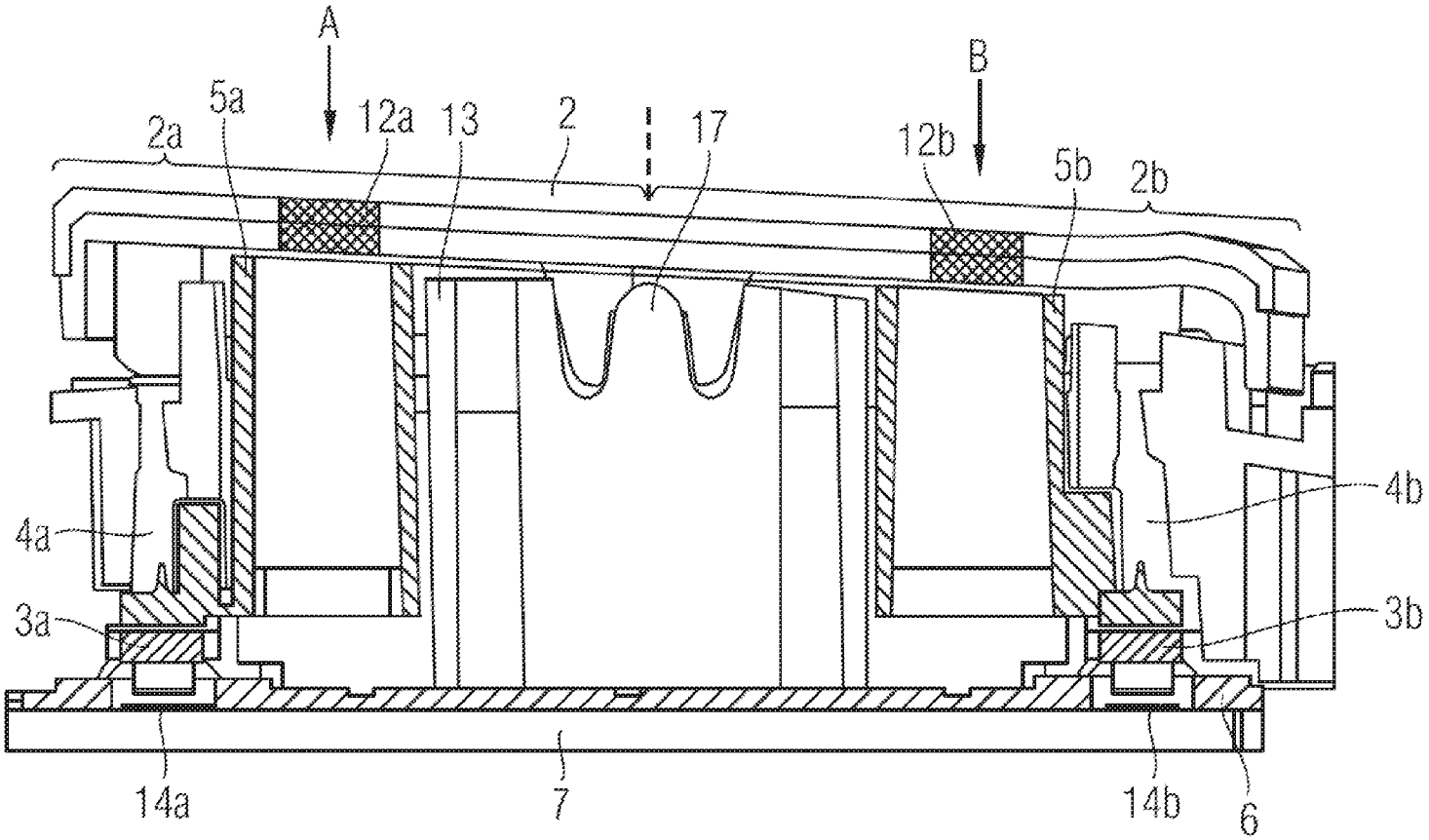
FIG. 1 is a vertical sectional view across the rocker switch 1 according to the present invention.

In an embodiment of the present invention, the rocker switch comprises an actuating part pivotably mounted at the housing comprising at least two opposing actuating surfaces. By the actuating surfaces, a respective actuating direction associated thereto will be defined. The actuating directions are pairwise opposed. "Opposing" actuating directions is understood in the present invention to mean that actuation of either one of the actuating surfaces in either one of the actuating directions is opposed to the other actuation of the other one of the actuating surfaces in the respective other actuating direction. In an embodiment of the present invention, the rocker switch can, for example, be a four-way rocker switch with four actuating directions that are opposed in pairs. In another embodiment of the present invention, the rocker switch can, for example, be a two-way rocker switch with two actuating directions and consequently with a first and a second actuating surface and respective actuating directions associated thereto.

In an embodiment of the present invention, at least one actuating surface has a lighting surface, which is to be backlit. "Backlit" in the present invention is understood to mean that the lighting device is arranged on the side of the actuating part facing away from the actuating surface. According to an embodiment of the present invention, the at least one lighting device will not be moved with the actuating part, but is rather fixed to the housing, for example, via a circuit board, so that the actuating part moves in relation to the lighting device during actuation. In an embodiment of the present invention, the at least one lighting device is, for example, a light-emitting diode, having, for example, a SMD type design. The number of lighting devices may correspond to the number of the actuating directions.

In an embodiment of the present invention, at least one electromechanical pushbutton is provided. In an embodiment of the present invention, a pushbutton can, for example, be provided for each actuating surface, and hence for each actuating direction, so that the end positions and the intermediate neutral position eventually provided may be associated with an electrical and distinct switch position by way of the switching state of the pushbutton.

In an embodiment of the present invention, a plunger may be provided that is movably supported at the housing. In an embodiment of the present invention, the plunger can, for example, include a plunger that is mounted at the housing to be translationally displaceable in operative connection between the actuating part and the pushbutton, via which the actuating part acts on the electromechanical pushbutton. The term "plunger" may be broadly interpreted. According to an embodiment of the present invention, the plunger may be movably supported at the housing so that a rigid and/or integral connection of the plunger with the actuating part can be avoided. The plunger is, for example, essentially formed in a pin shape. In an embodiment of the present invention, one plunger is, for example, associated with each electromechanical pushbutton.

In an embodiment of the present invention, a multiple part, for example, a two-part, telescoping light duct can be provided. The light duct defines a light channel between the at least one lighting means and the associated lighting surface. In an embodiment of the present invention, the light duct can, for example, extend from the lighting device to the rear side of the actuating part facing away from the actuating surface and terminate in the region of the associated lighting surface. "Telescoping" may be broadly interpreted and generally means any modification of the longitudinal extension of the light duct. In an embodiment of the present invention, this telescoping movement can, for example, be transversal, with the exception of a possible angular bending between the light duct sections, due to support and clearance conditions. In another embodiment of the present invention, the light duct can, for example, be offset to the pivot axis of the actuating part defined by the pivotable support at the housing.

In an embodiment of the present invention, the light duct comprises a tubular lower light duct section associated with the electromechanical pushbutton and a tubular upper light duct associated with the actuating part. In this embodiment, this association, for example, concerns a spatial arrangement condition, thus, the lower light duct section is arranged most closely adjacent to the electromagnetical pushbutton, whereas the upper light duct section is arranged most closely adjacent to the actuating part. The meaning of the term "most closely adjacent" arises from the comparison of the relative arrangement condition of the upper and lower light duct section, respectively, in relation to the actuating part and the pushbutton, respectively.

In an embodiment of the present invention, the upper light duct and the actuating part are not rigidly coupled with each other or, for example, are not integrally formed. The upper light duct and the actuating part may, for example, be movably supported in relation to each other, and they may be biasedly supported into mutual engagement.

The terms "upper" and "lower" are intended to distinguish the respective light duct sections and are not intended to require a particular arrangement of these sections in relation to the gravitational field, but, according to the present invention, they relate to the arrangement thereof as seen from the observer's field of vision. In an embodiment of the present invention, the upper light duct section may be rigidly coupled with the plunger. The term "coupled" is intended to also comprise a configuration in which the upper light duct sections themselves form the plunger. The rigid coupling with the plungers has the advantage that the upper light duct sections, among others, reliably follow the movement of the plunger in the actuating direction, and eventually also reliably follow the movement upon resetting.

In an embodiment of the present invention, the upper light duct section is elastically biased across the plunger by way of the electromechanical pushbutton in the direction of the actuating part. In another embodiment of the present invention, the upper light duct section may be elastically biased against the actuating part. The upper light duct section thus reliably abuts the rear side of the actuating part, i.e., the side of the actuating part facing away from the user. This provides that, during actuation, the light duct which is arranged on the non-abutting side, and which side lifts up during actuation of the actuating part, will extend its longitudinal extension with the plunger movement so that the increased distance between the lighting surface associated thereto and the lighting device can be compensated by way of increasing the longitudinal extension. In doing so, effective shielding of light and, consequently, effective light guidance to the lighting surface associated thereto is accomplished without, for example, a "lateral" leakage of scattered light at the gap between the housing or eventually a shield surrounding the actuating part and the actuating part.

In an embodiment of the present invention, for an improved shielding of light in the observer's direction, the lower light duct section is arranged to engage the respective upper light duct section.

In an embodiment of the present invention, a key pad can, for example, also be provided, and the respective electromechanical pushbutton can, for example, be defined by a switch dome of the key pad and by switch contact surfaces cooperating with the switch dome. The switch contact surfaces may, for example, be arranged on the circuit board and define an open switch contact that will be closed via a contact pile fixed at the switch dome and made of conductive material in an end position of the actuating part. The key pad may, for example, be made of elastic material, such as silicone rubber.

The lower light duct section may, for example, be made of elastic material such as silicone rubber. In an embodiment of the present invention, the lower light duct section may also be formed by the previously-described key pad.

In an embodiment of the present invention, the light duct may, for example, have a rectangular cross section, with the upper and lower sections differing in a cross-sectional area dimension. "Rectangular" is not intended to be interpreted too narrowly and also comprises rounded or beveled corners.

In an embodiment of the present invention, two light ducts, one per every actuating direction, can, for example, be provided, and moreover, the upper light duct sections can be mutually coupled by a gear (also referred to as mechanics), for example, a lever gear, so that when actuating the actuating part in either one of the two actuating directions, either one of the two light ducts, for example, the one associated with the actuated plunger, will be telescopically shortened, whereas the other one of the two will be telescopically elongated.

In embodiment of the present invention, the lever gear can, for example, comprise a connecting bar connecting the upper light sections, and the housing can, for example, comprise a projection forming a bearing for the bar. The mechanics may thereby be realized in a comparably simple and construction-space saving manner.

In an embodiment of the present invention, the actuating part can, for example, be made of a transparent or translucent material, and the lighting surface can, for example, be defined by a masking layer of opaque material, for example, a metallization.

In an embodiment of the present invention, the actuating part can, for example, be resettably mounted opposite the actuating directions (A, B) in an intermediate neutral position. Resetting is, for example, accomplished by the respective electromechanical pushbutton provided per actuating direction.

The rocker switch according to an embodiment of the present invention can, for example, make use of in any of the previously-described embodiments in a motor vehicle.

The present invention as well as the technical environment are explained in detail below by way of the drawings. It is to be noted that the drawings show an embodiment of the present invention, which invention, however, is not limited thereto.

Figure 2:
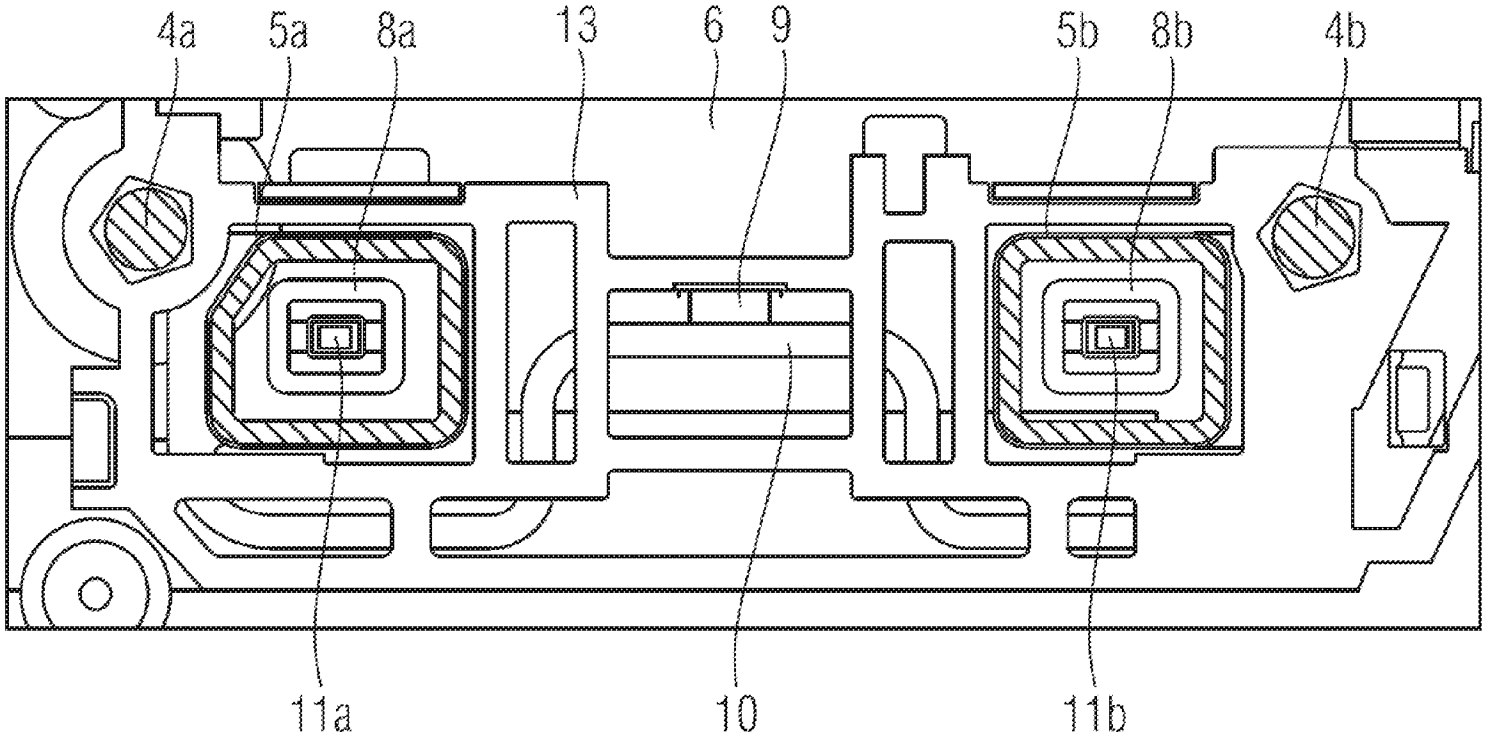
FIG. 2 is a horizontal sectional view across the rocker switch 1 according to the present invention of FIG. 1.
Figure 3:
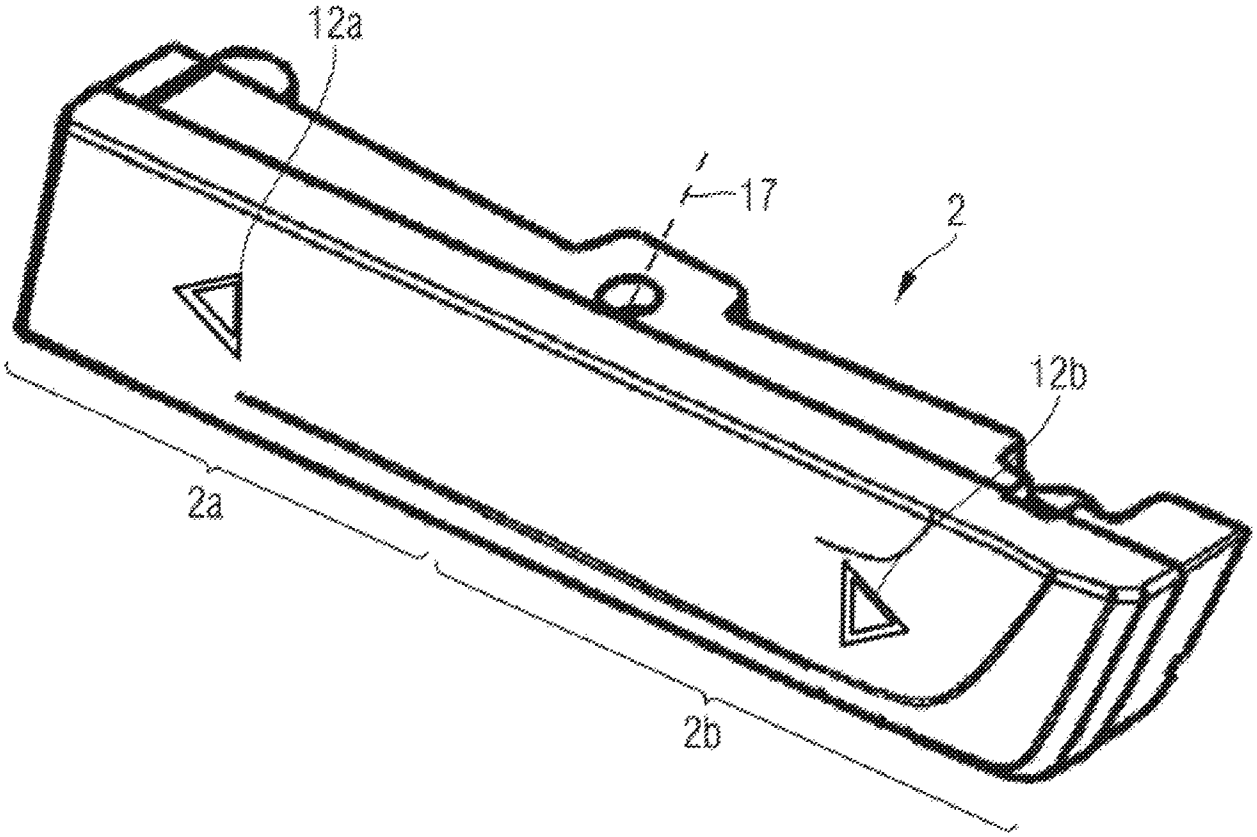
FIG. 3 is a perspective detailed view of the actuating part 2 of the rocker switch 1 according to the present invention of FIG. 1.

Referring now to the FIGS. 1 and 2, an embodiment of the rocker switch 1 according to the present invention will be described. It comprises a housing 13. The housing 13 has pins defining a pivot axis 17. At the pins, an actuating part 2 is pivotably supported about the pivot axis 17, which is pivotable in two opposing directions A and B from a neutral position shown in FIG. 1. For each one of the actuating directions A, B the actuating part 2 comprises an actuating surface 2*a*, 2*b* associated thereto, the planar extension of which arises from FIG. 3 and the common lateral limitation of which is defined by the course of the pivot axis 17.

Either one of these actuation surfaces 2*a*, 2*b* comprises a lighting surface 12*a*, 12*b* that is to be backlit. It is the reference numbers 12*a*, 12*b*, respectively indicating the respective switching function corresponding to the respective actuating direction. As shown in FIG. 2, the backlighting will be accomplished by the respective lighting device 11*a*, 11*b* that is associated to the respective lighting surfaces 12*a*, 12*b*. These are SMD-type light-emitting diodes 11*a*, 11*b* which are arranged on a circuit board 7 that is mounted to the housing 13.

Figure 5:
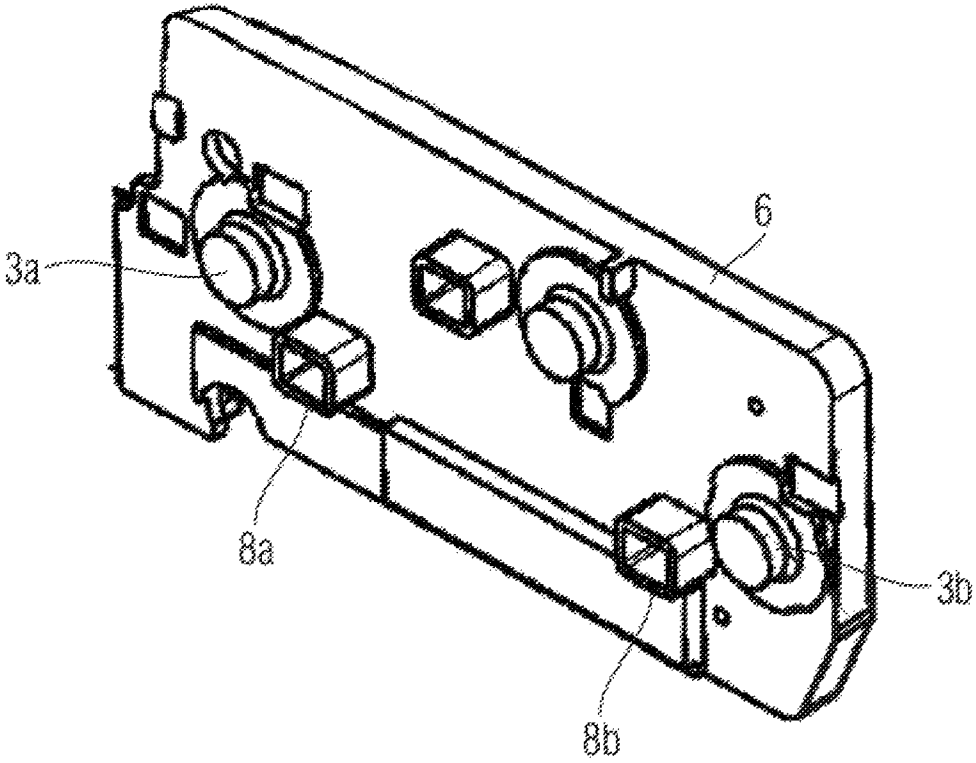
FIG. 5 is a perspective detailed view of the key pad 6 of the rocker switch 1 according to the present invention of FIG. 1.
Figure 6:
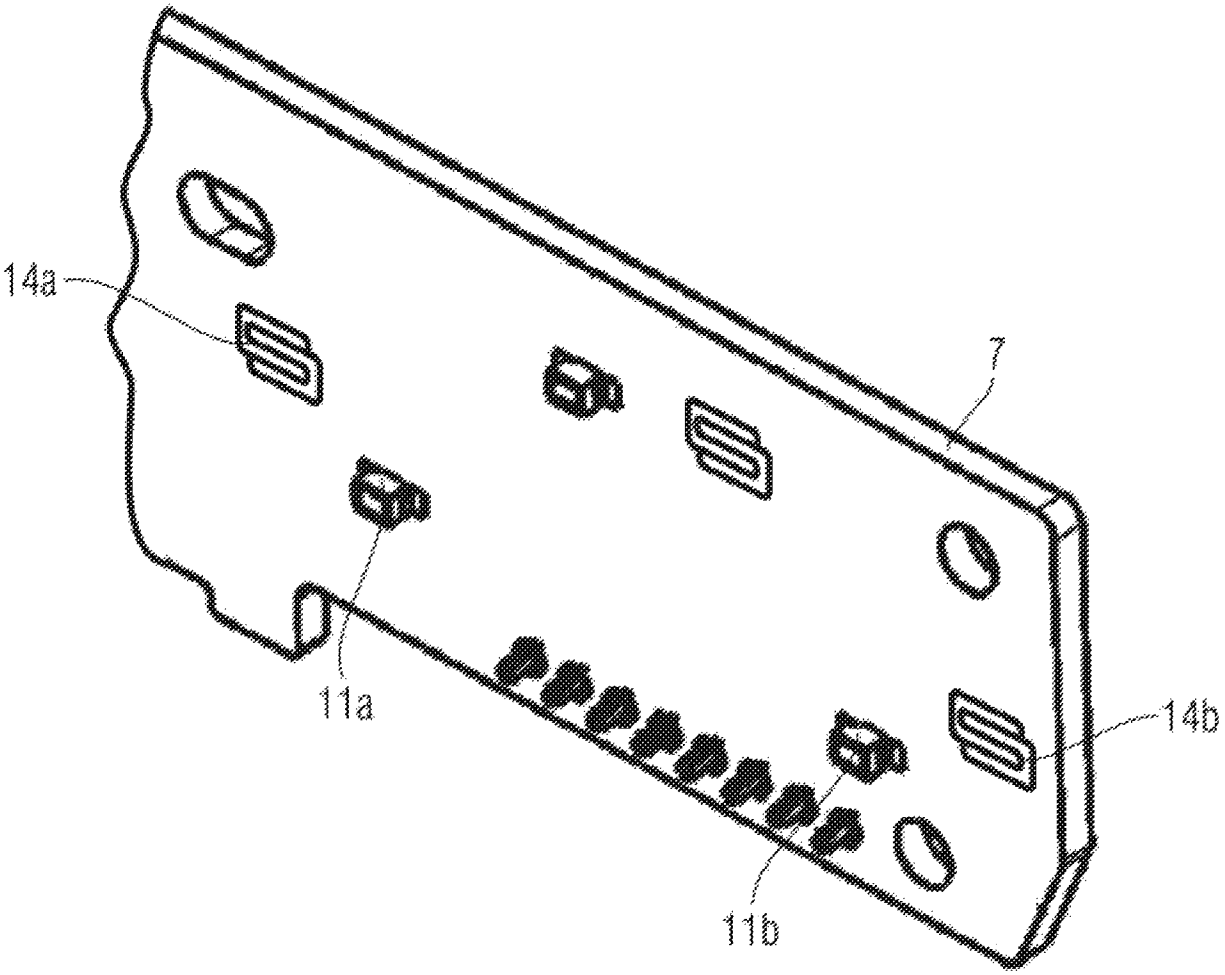
FIG. 6 is a perspective detailed view of the circuit board 7 of the rocker switch 1 according to the present invention of FIG. 1.

The rocker switch 1 according to the present invention has one actuator (3*a*, 3*b*, 14*a*, 14*b*), which can be provided as an electromechanical pushbutton, per actuating direction A, B. Each actuator/pushbutton is formed of a switch dome 3*a*, 3*b* of a key pad 6 consisting of silicone rubber that is arranged adjacent to the previously-described circuit board 7 between the actuating part 2 and the circuit board 7. The switch domes 3*a*, 3*b* each have a contact pile of conductive material that are provided for establishing the contact made of two isolated contact surfaces 14*a* or 14*b*, respectively, that are arranged on the circuit board 7. A perspective view of the switching pad 6 is shown in FIG. 5, whereas a perspective view of the circuit board 7 is shown in FIG. 6.

In order to effect change of the switching state of the respective actuators 3*a*, 3*b*, 14*a*, 14*b* in the respective actuating direction A, B, the actuating part 2 acts via plungers 4*a*, 4*b* associated thereto on the respective pushbutton 3*a*, 3*b*, 14*a*, 14*b* a, as shown in FIG. 1. The plungers 4*a*, 4*b* are each mounted at the housing 13 to be translationally displaceable. For this, the housing 13 comprises appropriate breakthroughs 15*a* and 15*b*, as it is shown in the FIGS. 7 and 8.

If the actuating part 2 is actuated in the region of the actuating surfaces 2*a*, i.e., is pushed down, as it is set forth in FIG. 1, the plunger 4*a* becomes translatorically displaced, thus effecting change of the switching state of the pushbuttons 3*a*, 14*a*. If, however, the actuating part 2 is actuated in the region of the actuating surface 2*b*, i.e. pushed down, the plunger 4*b* becomes translatorically displaced, thus effecting a change of the switching state of the pushbuttons 3*b*, 14*b*. Resetting effected by the pushbutton 3*a*, 14 or 3*b*, 14*b*, respectively, provides for the plunger 4*a* or 4*b*, respectively, to become elastically biased against the actuating part 2 and thus for the non-actuated actuating part to be reset into the neutral position, shown in FIG. 1.

Figure 7:
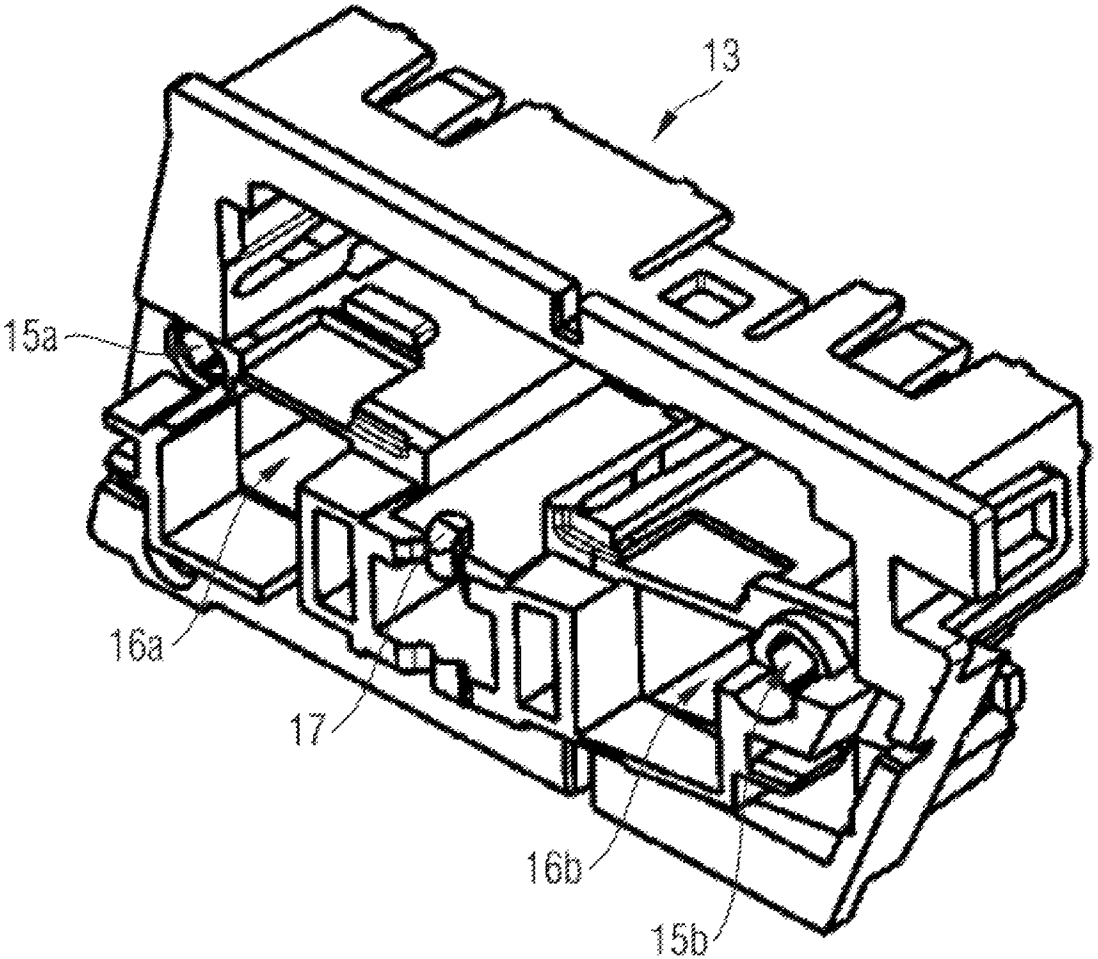
FIG. 7 is a perspective detailed view onto the upper side of the housing 13 of the rocker switch 1 according to the present invention of FIG. 1.
Figure 8:
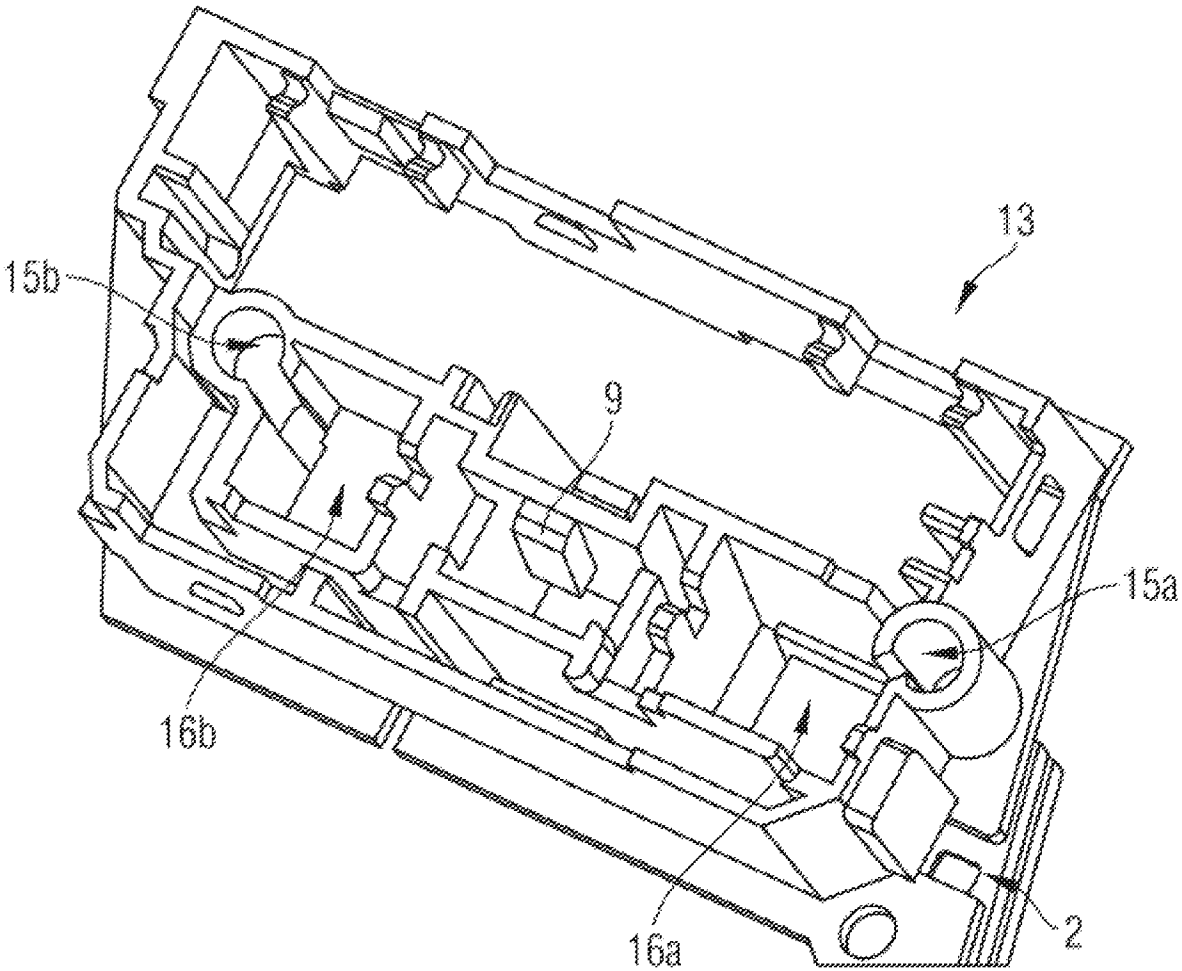
FIG. 8 is a perspective detailed view onto the lower side of the housing 13 of the rocker switch 1 according to the present invention of FIG. 1.

For effectively backlighting and for avoiding leakage of light at an unwanted site, i.e., outside the surface 12*a* or 12*b* to be backlit, respectively, a telescoping light duct is provided per actuating surfaces 2*a*, 2*b* that is arranged in a respective breakthrough 16*a*, 16*b* of the housing 13 shown in FIGS. 7 and 8. In this situation, telescoping light ducts (5*a*, 5*b*, 8*a*, 8*b*) are arranged so that the course thereof does not intersect the pivot axis 17, as it is seen in FIG. 1, the course of which is offset to the pivot axis 17.

The telescoping light ducts having an essentially rectangular cross section each comprise an upper light duct section 5*a* or 5*b*, respectively, and a lower light duct section 8*a* or 8*b*, respectively, each of the lower light duct section 8*a*, 8*b* being arranged to engage into the upper light duct section 5*a*, 5*b*. The extent of the overlapping resulting from the engaging arrangement of the light duct sections varies depending on the movement of the associated plungers 4*a*, 4*b*.

Figure 4:
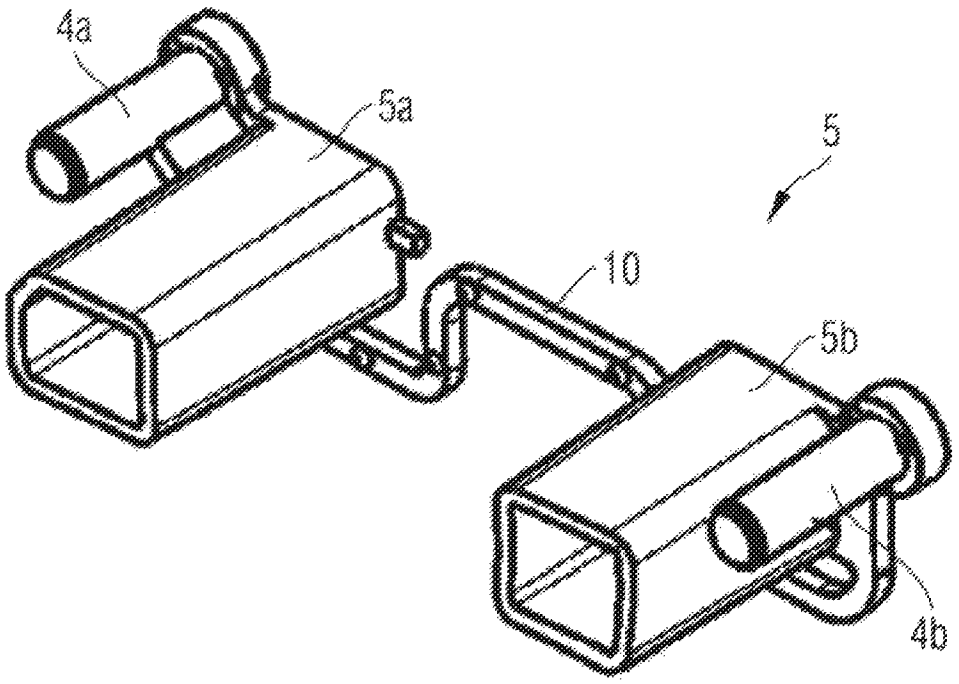
FIG. 4 is a perspective detailed view of the rocker switch 1 according to the present invention of FIG. 1 formed of the plungers and a part 5 formed of the upper light duct sections.

As it is seen from FIG. 4, the plungers 4*a*, 4*b* are integrally coupled with the upper light duct sections 5*a*, 5*b*. In this way, the upper light duct section 5*a*, 5*b* are safely and essentially translatorically displaceable across the plungers 4*a*, 4*b* and the guidance thereof, via breakthroughs 15*a*, 15*b*, in relation to the housing 13. In this way, a guidance of the upper light duct sections 5*a*, 5*b* that is reliable due to coupling to the movement of the plunger 4*a*, 4*b* will be accomplished and leakage of the light at an unwanted site will be avoided. This not only applies to the guidance of the upper light duct section 5*a*, 5*b* during actuating, but also to the performance thereof during relief of the non-actuated actuating part 2. By directly coupling the upper light duct section 5*a*, 5*b* with the plunger 4*a*, 4*b*, the upper light duct section 5*a*, 5*b* will reliably be biased by the respective pushbutton 3*a*, 14*a*; 3*b*, 14*b* across the respective plunger 4*a*, 4*b* in the direction of the actuating part 2.

As it is seen from FIG. 4, the upper light duct sections 5*a*, 5*b* are furthermore coupled with each other via a bar 10. The housing 13 comprises a projection 9 forming a support for the bar 10, as is shown in the FIGS. 2 and 8. The lever gear, which is thereby formed by projection 9 and bar 10, besides the resetting and elastically biasing effect of the pushbutton 3*a*, 14*a*; 3*b*, 14*b*, provides for the movements of the upper light duct sections 5*a*, 5*b* to be mutually coupled, i.e., when actuating the actuating part 2 in either one of the actuating directions A, B, one respective light duct 5*a*, 8*a*; 5*b*, 8*b* of the pair, especially the light duct immediately below the actuated actuating surface 2*a* or 2*b*, respectively, will become telescopically shortened, whereas the other remaining light duct 5*a*, 8*a*; 5*b*, 8*b* of the pair will become telescopically elongated. It will be provided in this way that the upper light duct section 5*a* or 5*b*, respectively, that is located directly below the non-actuated actuating surface 2*a* or 2*b*, respectively, will follow the movement of the actuating part 2 that lifts up at this side, thereby keeping a minimum distance therefrom so that even at a not directly actuated actuating surface 2*a* or 2*b*, an effective light guidance of the actuating part 2 will respectively be accomplished.

The present invention is not limited to embodiments described herein; reference should be had to the appended claims.

What is claimed is:

1. A rocker switch comprising:

a housing;

an actuating part pivotably mounted at the housing, the actuating part comprising at least two opposing actuating surfaces with two opposing actuating directions associated thereto, at least one of the at least two actuating surfaces comprising a lighting surface configured to be backlit;

at least one lighting device attached to the housing configured to backlight the lighting surface;

at least one electromechanical pushbutton;

at least one multiple-part telescoping light duct; and at least one plunger displaceably supported at the housing, the at least one plunger being configured to act through the actuating part on the at least one electromechanical pushbutton and the at least one multiple-part telescoping light duct so as to define a light channel between the at least one lighting device and the lighting surface, wherein, the at least one multiple-part telescoping light duct comprises a tubular lower light duct section corresponding to the at least one electromechanical pushbutton, and a tubular upper light duct section corresponding to the lighting surface of the actuating part, the tubular upper light duct section being rigidly coupled with the at least one plunger and being elastically biased by the at least one electromechanical pushbutton in a direction of the actuating part, and the actuating part and the tubular upper light duct section are biasedly supported into mutual engagement with each other.

2. The rocker switch as recited in claim 1, wherein the tubular upper light duct section is elastically biased by the at least one electromechanical pushbutton against the actuating part.

3. The rocker switch as recited in claim 1, wherein the tubular lower light duct section is configured to engage the tubular upper light duct section.

4. The rocker switch as recited in claim 1, further comprising:

a key pad, wherein, the at least one electromechanical pushbutton comprises a switch dome incorporated in the key pad and a switch contact surface configured to cooperate with the switch dome.

5. The rocker switch as recited in claim 4, wherein the tubular lower light duct section is formed by the key pad.

6. The rocker switch as recited in claim 1, wherein the at least one light duct further comprises a rectangular cross-section.

7. The rocker switch as recited in claim 1, further comprising:

a gear, wherein, the at least one multiple-part telescoping light duct includes two multiple-part telescoping light ducts, each of the two multiple-part telescoping light ducts corresponding to a respective one of the two opposing actuating directions, and the two multiple-part telescoping light ducts each comprise a tubular upper light duct section which is mutually coupled by the gear so that, during an actuating of the actuating part in either one of the two opposing actuating directions, one of the two multiple-part telescoping light ducts is telescopically shortened, and the other of the two multiple-part telescoping light duct is telescopically elongated.

8. The rocker switch as recited in claim 7, wherein, the gear comprises a connecting bar which connects the two tubular upper light sections, and the housing comprises a projection which forms a support for the connecting bar.

9. The rocker switch as recited in claim 1, wherein, the actuating part further comprises a transparent or translucent material, and the lighting surface comprises a masking layer comprising an opaque material.

10. The rocker switch as recited in claim 1, wherein the actuating part is configured to be resettably supported opposing the actuating directions in an intermediate neutral position.

11. A rocker switch comprising:

a housing;

an actuating part pivotably mounted at the housing, the actuating part comprising at least two actuating surfaces with two actuating directions associated thereto, at least one of the two actuating surfaces comprising a lighting surface configured to be backlit;

at least one lighting device attached to the housing configured to backlight the lighting surface;

at least one electromechanical pushbutton;

at least one multiple-part telescoping light duct; and at least one plunger displaceably supported at the housing, the at least one plunger being configured to act through an actuation of the actuator part on the at least one electromechanical pushbutton and the at least one multiple-part telescoping light duct so as to define a light channel between the at least one lighting device and the lighting surface, wherein, the at least one multiple-part telescoping light duct comprises a tubular lower light duct section corresponding to the at least one electromechanical pushbutton and a tubular upper light duct section corresponding to the lighting surface of the actuating part, the tubular upper light duct section being coupled with the at least one plunger and being biased by the at least one electromechanical pushbutton in a direction of the actuating part, and the actuating part and the tubular upper light duct section are biasedly supported into mutual engagement with each other.

* * * * *